US009193494B2

(12) United States Patent
Smith et al.

(10) Patent No.: US 9,193,494 B2
(45) Date of Patent: Nov. 24, 2015

(54) CONTAINER HAVING A TAMPER-INDICATING COMPONENT

(71) Applicant: Owens-Brockway Glass Container Inc., Perrysburg, OH (US)

(72) Inventors: Roger P. Smith, Perrysburg, OH (US); Kenneth S. Bloom, Bloomdale, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 54 days.

(21) Appl. No.: 13/832,666

(22) Filed: Mar. 15, 2013

(65) Prior Publication Data

US 2014/0263152 A1 Sep. 18, 2014

(51) Int. Cl.

| | |
|---|---|
| ***B65D 1/02*** | (2006.01) |
| ***B65B 7/28*** | (2006.01) |
| ***B65D 49/00*** | (2006.01) |

(52) U.S. Cl.

CPC ..... *B65D 1/023* (2013.01); *B65B 7/2842* (2013.01); *B65D 49/00* (2013.01)

(58) Field of Classification Search

CPC ..... B65D 1/023; B65D 23/006; B65D 49/00; B65D 49/12

USPC ..... 215/14, 49, 50, 42, 47; 206/807; 220/201, DIG. 34

See application file for complete search history.

(56) References Cited

U.S. PATENT DOCUMENTS

| | | | | | |
|---|---|---|---|---|---|
| 596,588 | A | | 1/1898 | Grow | |
| 765,376 | A | * | 7/1904 | Burns | 215/49 |
| 815,112 | A | | 3/1906 | O'Dell et al. | |
| 822,739 | A | * | 6/1906 | Henderson | 215/50 |
| 1,009,237 | A | * | 11/1911 | Glass | 215/49 |
| 1,166,755 | A | * | 1/1916 | Fortney | 215/49 |
| 1,172,982 | A | | 2/1916 | Gregory | |
| 1,199,765 | A | * | 10/1916 | Cook | 215/363 |
| 1,415,741 | A | * | 5/1922 | Walsh | 215/14 |
| 1,423,463 | A | * | 7/1922 | Shaw | 383/60 |
| 2,017,938 | A | * | 10/1935 | Berger | 215/21 |

(Continued)

FOREIGN PATENT DOCUMENTS

| | | | |
|---|---|---|---|
| EP | 1157802 | A2 * | 11/2001 |
| GB | 2078194 | A * | 1/1982 |

(Continued)

OTHER PUBLICATIONS

PCT Search Report and Written Opinion, Int. Serial No. PCT/US2014/020960, Int. Filing Date: Mar. 6, 2014, Applicant: Owens-Brockway Glass Container Inc., Mail Date: Sep. 18, 2014.

*Primary Examiner* — Sue A Weaver

(57) ABSTRACT

A tamper-evident product and related methods of production. A container includes a neck, and a tamper-evidencing component separate from the container and carried by the neck of the container in direct contact with a corresponding portion of the container neck. The component is composed of material that has higher thermal conductivity than that of a material of the container so as to concentrate heat in the corresponding portion of the container neck. The neck is thermally responsive to application of heat pursuant to tampering with the product by at least one of the following responses: an irreversible change in visual appearance of the corresponding portion of the container neck, or fracture of the container neck at the corresponding portion of the container neck.

23 Claims, 2 Drawing Sheets

(56) References Cited

U.S. PATENT DOCUMENTS

| | | | | | |
|---|---|---|---|---|---|
| 2,019,057 | A | | 10/1935 | Rasmussen | |
| 2,030,617 | A | | 2/1936 | Whitney | |
| 2,101,598 | A | | 12/1937 | Riedel | |
| 2,146,000 | A | * | 2/1939 | Hutchcroft | 222/541.2 |
| 2,155,290 | A | * | 4/1939 | Baldwin et al. | 215/22 |
| 2,203,266 | A | * | 6/1940 | Leviseur | 215/233 |
| 2,439,628 | A | * | 4/1948 | Kopecky | 215/360 |
| 2,498,985 | A | | 2/1950 | Dotts, Jr. et al. | |
| 3,399,811 | A | | 9/1968 | Miller | |
| 4,125,640 | A | * | 11/1978 | Conant et al. | 427/250 |
| 4,392,576 | A | * | 7/1983 | Berger et al. | 215/12.2 |
| 4,919,983 | A | * | 4/1990 | Fremin | 428/35.7 |
| 5,178,055 | A | * | 1/1993 | Shinohara et al. | 91/376 R |
| 5,769,920 | A | * | 6/1998 | Sweetland et al. | 65/374.15 |
| 5,806,697 | A | | 9/1998 | Harbutt et al. | |
| 5,820,951 | A | * | 10/1998 | Osborne | 428/29 |
| 6,666,852 | B2 | * | 12/2003 | Niedospial, Jr. | 604/415 |

FOREIGN PATENT DOCUMENTS

| | | |
|---|---|---|
| GB | 2176467 | 12/1986 |
| GB | 2302867 | 2/1997 |

* cited by examiner

CONTAINER HAVING A TAMPER-INDICATING COMPONENT

The present disclosure is directed to containers and, more particularly, to container fitments.

BACKGROUND AND SUMMARY OF THE DISCLOSURE

A container for carrying a liquid product can include a fitment that renders the container non-refillable so as to impede or prevent efforts to refill the container with inferior products. U.S. Pat. No. 3,399,811 illustrates a container of this type.

A general object of the present disclosure, in accordance with one aspect of the disclosure, is to provide a container including a tamper-evidencing component that is non-removably secured to the container and that evidences efforts to tamper with the package via breakage and/or discoloration of the container.

The present disclosure embodies a number of aspects that can be implemented separately from or in combination with each other.

A product in accordance with one aspect of the disclosure includes a glass container including a neck, and an anti-refill fitment carried in the neck to deter refill of the container and at least partially composed of plastic. The product also includes a metal ring carried in at least one of the neck of the container or the fitment and in direct contact with a corresponding portion of the container neck, such that heating of the product pursuant to tampering results in at least one of discoloration of the container neck or fracture of the container neck.

In accordance with another aspect of the disclosure, there is provided a product that includes a container including a neck, and a tamper-evidencing component separate from the container and carried by the neck of the container in direct contact with a corresponding portion of the container neck and composed of material that has higher thermal conductivity than that of a material of the container so as to concentrate heat in the corresponding portion of the container neck. The container neck is thermally responsive to application of heat pursuant to efforts to tamper with the product by at least one of the following responses: an irreversible change in visual appearance of the corresponding portion of the container neck, or fracture of the container neck at the corresponding portion of the container neck.

In accordance with a further aspect of the disclosure, there is provided a method of producing a product that includes (a) flowing liquid into a container having a neck, (b) non-removably coupling an anti-refill fitment into the neck of the container to render the product non-refillable, and (c) coupling a tamper-evidencing component to at least one of the fitment or the container neck so that the component is in direct contact with a corresponding portion of the container, such that heating of the product pursuant to tampering concentrates heat in the component and in the corresponding portion of the container to result in at least one of discoloration of the container neck or fracture of the container neck.

In accordance with an additional aspect of the disclosure, there is provided a method of producing a product that includes (a) forming a glass container including a neck having an outer surface and an annular groove in the outer surface, and (b) embedding a metal ring in the annular groove of the container neck.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1B:
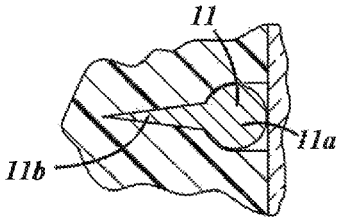
FIG. 1B is an enlarged, fragmentary view of a portion of the product of FIG. 1A, taken from circle 1B of FIG. 1.
Figure 1C:
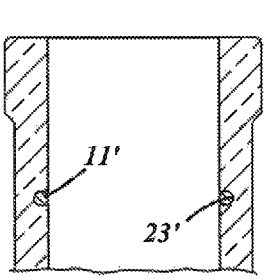
FIG. 1C is a fragmentary view of a portion of a product in accordance with an illustrative embodiment of the present disclosure and including a tamper-evidencing component carried in a wall of a container.
Figure 1A:
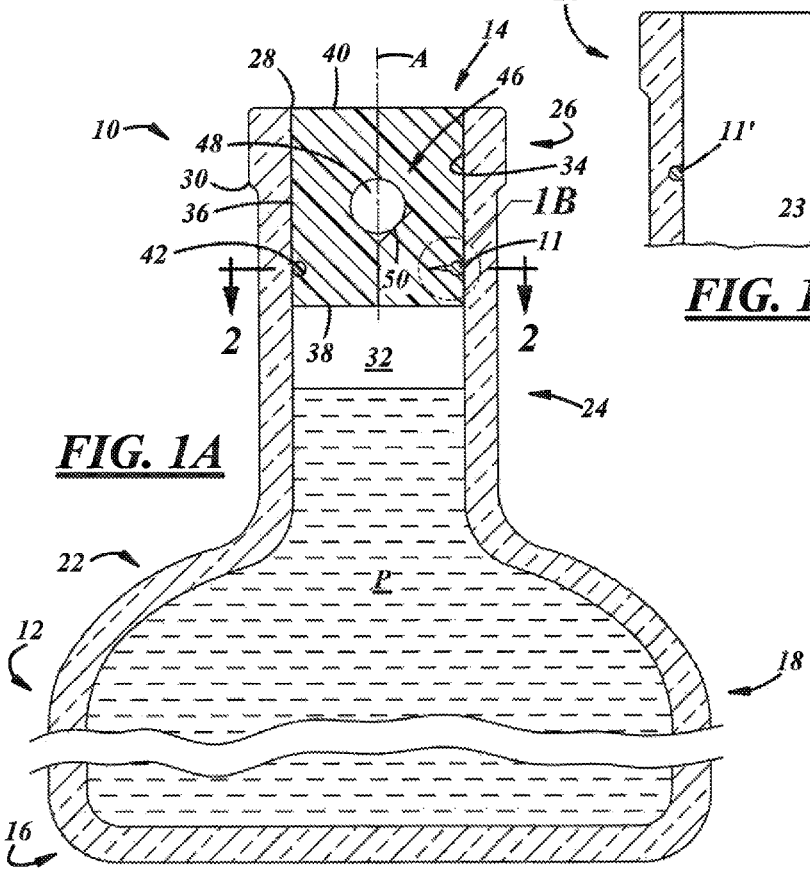
FIG. 1A is a fragmentary elevational view of a product in accordance with an illustrative embodiment of the present disclosure and including a container and a fitment coupled to the container to render the container non-refillable.

FIG. 1A illustrates a product 10 in accordance with an illustrative embodiment of the disclosure as including a container 12 to hold a liquid product P, a dispensing fitment 14 coupled to the container 12, and a tamper-indicating component 11 carried between the container 12 and the fitment 14. The fitment 14 may be non-removably secured to the container 12. The terminology "non-removably secured" includes a manner in which the fitment 14 is, by design-intent, not intended to be removed from the container 12 without damaging the container and/or fitment 14 or otherwise visibly compromising the structural and/or functional integrity of either or both. Also, the fitment 14 may render the container 12 non-refillable. In other words, the fitment 14 may prevent or at least impede efforts to refill the container 12, for example, with counterfeit liquid products. The terminology "non-refillable" is used interchangeably herein with the terms refill-resistant and anti-refill, and includes a characteristic of the fitment 14 which, by design intent, is not intended to be refilled without damaging the container 12 and/or fitment 14 or otherwise visibly compromising the structural and/or functional integrity of either or both. As will be described below, the component 11 may facilitate evidencing of efforts to tamper with the product 10, for example, via breakage or discoloration of the container 12 when someone attempts to defeat the non-refillable fitment 14.

Figure 2:
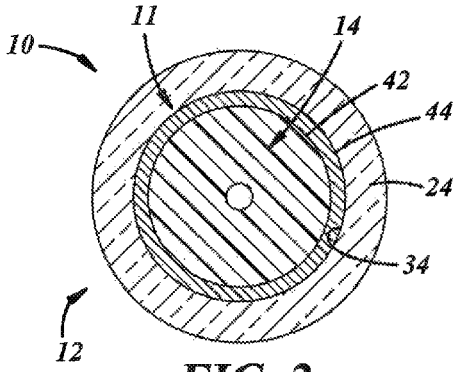
FIG. 2 is a cross-sectional view of the product of FIG. 1A, taken along line 2-2 of FIG. 1.

The container 12 can be a bottle, for example, a wine or spirits bottle or any other suitable type of bottle, jar, or any other suitable type of container, and can be composed of glass, ceramic, metal, plastic, or any other suitable material (s). The container 12 may include a bottom or base 16, a body 18 that may include a sidewall 20 extending in a directional axially away from the base 16 along a central longitudinal axis A of the container 12. The container 12 also may include a shoulder 22 extending in a directional axially away from the sidewall 20, and a neck 24 extending in a directional axially away from the shoulder 22 and including a neck finish 26. As used herein, directional words such as top, bottom, upper, lower, radial, circumferential, lateral, longitudinal, transverse, vertical, horizontal, and the like are employed by way of description and not limitation. The neck finish 26 may include an open end or mouth 28 of the container 12, and one or more closure engagement elements 30, for example, a crown closure bead, helical threads, or any other suitable feature(s), for coupling to a closure (not shown). The geometry of the container 12 of FIGS. 1A and 2 is illustrative only, and any other suitable geometries may be used.

The container neck 24 may include an interior passage 32 to carry the fitment 14 and to communicate liquid out of the container body 18 and through and out of the neck 24. The passage 32 may include an interior surface 34 in which the fitment 14 may be positioned. The surface 34 may be of cylindrical shape or of any other suitable geometry.

The component 11 may include a ring, as shown in the illustrated embodiment. But in other embodiments, the component 11 may be of any other suitable geometry. In the ring embodiment, the component 11 may extend completely circumferentially 360 degrees around the fitment 14 and/or the container neck 24. As shown in FIG. 1B, the component 11 may include a circumferentially extending rim 11*a* and a plurality of circumferentially spaced, radially extending spokes 11*b* to draw heat from a greater area.

The component 11 may be relatively rigid. For example, the component 11 may be composed of metal, or any other suitable rigid material. For instance, the component 11 may be composed of a ferrous metal, for instance, iron or steel, to facilitate separation (via magnets or the like) of the component 11 from container material during recycling. In other embodiments, the component 11 may be composed of aluminum, copper, titanium, stainless steel, or non-metal.

With reference to FIG. 1C, in another embodiment, a component 11' may be a snap ring that may be carried in an interior of a container neck 24' in any suitable manner. For example, the component 11' may be retained in an internal groove 23', between internally extending projections (not shown), or in any other suitable portion of the container neck 24'.

With reference to FIG. 1A, various features of the fitment 14 illustrated in the drawing figures are illustrative only, and may be of any other suitable type or construction. The fitment 14 includes an axially extending circumferential outer wall 36 to contact the interior surface 34 of the container 12. The outer wall 36 may be a ring or ring-shaped, for example of oval or cylindrical shape, or of any other suitable shape corresponding to the shape of the corresponding portion of the container neck 24. The fitment 14 also may include an inlet wall 38 in the container 12 and an axially oppositely disposed outlet wall 40 that may be flush with, or may be recessed or extended past, the open mouth 28 of the container 12 and that may extend transversely with respect to the outer wall 36. As used herein, the term "transverse" may mean disposed at some non-zero angle with respect to the longitudinal axis A of the container 12 and along any direction intersecting the container 12 and may include but is not limited to a radial direction.

As also shown in FIG. 2, the fitment 14 also may include an annular relief 42, which may carry the tamper-indicating component 11 therein. Moreover, at least a portion of the component 11 may include a radially outer surface 44 in direct contact with the interior surface 34 of the container neck 24. In the illustrated embodiment, the component 11 may be in complete circumferential contact with the interior surface 34 of the container neck 24. In fact, the component 11 may be interference fit to the neck 24, for example, by press-fit, shrink-fit, or the like, such that the outer diameter of the component 11 may be larger than a corresponding portion of the inner diameter of the neck 24.

The fitment 14 further may include any suitable features to impede or prevent refilling of the container 12. For example, the fitment 14 may include a check valve 46 that may be carried within the outer wall 36. The check valve 46 may include an suitable movable check element like a check ball 48, seat 50, and passages. The fitment 14 may be composed of plastic, metal, glass, and/or the like. The illustrative check valve 46 permits flow of liquid out of the container body 18 but prevents or retards flow into the container body 18. Non-refillable fitments are well known to those of ordinary skill in the art, and any suitable type of such a fitment may be used, whether a check valve type of fitment, an air trap type of fitment, or any other suitable type of refill-resistant fitment.

The component 11 may be coupled to the container 12 in such a way that when a closure and/or fitment is reapplied, a discoloration area extends below the reapplied closure and/or fitment. For example, discoloration could occur by a heat sensitive and/or permanent thermochromic coating, or by an additive in the glass of the container 12, for example, pre-struck copper. Accordingly, when heat is applied to the glass in the region of the component 11, the copper would strike in that region, causing a visual change in the glass. A region larger than that in the immediate vicinity of the component 11 will experience a temperature increase pursuant to tampering, so the discoloration-affected region will be larger than just that occupied by the component 11.

In production, the liquid product P may be flowed into the container 12 in any suitable manner, and then the fitment 14 carrying the component 11 can be coupled into the neck 24 of the container 12 via an interference fit to render the product 10 tamper-evident. The fit between the outer wall 40 of the fitment 14 and the corresponding interior surface of the container 12 may be tight, wherein the fitment 14 cannot be removed without causing visible damage to the container 12. For example, the outer wall 40 of the fitment 14 may be larger than the corresponding interior surface of the container 12 that carries the fitment 14 when both the fitment 14 and the container 12 are at the same temperature. Also, although not shown, that container 12 and/or the fitment 14 may include any suitable interengagement features to non-removably secure the fitment 14 in the container neck 24.

The component 11 may facilitate evidencing of efforts to tamper with the package 10, for example, when someone attempts to remove or defeat the non-refillable fitment 14 and refill the container 12. For example, counterfeiters may apply heat to a portion of the package 10 pursuant to tampering or efforts to tamper with the package 10. More specifically, counterfeiters may attempt to partially or completely melt a plastic portion of the fitment 14, or may attempt to thwart other anti-tampering or anti-counterfeiting features, for instance, in an effort to either remove or damage such features, or to change the visual characteristics of such features so that they fail to indicate tampering or counterfeiting. In such a case, the component 11 will provide evidence of such efforts in one or both of the following ways. First, the component 11 may act as a thermal concentration element to break the container 12 immediately or to develop stresses that cause the container 12 to fracture at a later time, for instance, when a closure is reapplied to the container 12. Second, the component 11, through heat transfer, may effect a change in a visible state of the container 12.

In the first example, the component 11 may function as a thermal concentrator, wherein the component 11 may be composed of a material that has higher thermal conductivity than the material of the container 12. If counterfeiters apply heat to the fitment 14 or other portions of the package 10, then the application of heat will result in concentration of heat in the component 11 and in the corresponding portion of the container 12. Such concentration of heat thermally stresses the container 12 to fracture the container neck 24, thereby facilitating evidence of tampering with the container 12 and likely rendering the container 12 unusable. The container 12 would break because the component 11 concentrates heat in a corresponding narrow or thin area of the container 11, thereby creating a well-defined thermal expansion differential in the glass, and thus thermally stressing the container 12 beyond its breaking point. In effect, the component 11 cuts through the glass container 12 in a way similar to that of a heat knife cutting through glass.

In the second example, the component 11 may evidence tampering with the container 12 for example, via a state change of the container 12 upon application of heat pursuant to efforts to tamper with the package 10. For example, the application of heat may be that amount of heat sufficient to melt or at least partially melt the fitment 14 in an effort to remove the fitment 14. In another example, the heat may be sufficient to thwart other features that are designed to provide a visual indication of tampering or counterfeiting, for instance, by applying heat in an effort to either remove or damage such features, or to change the visual characteristics of such features so that they fail to indicate tampering or counterfeiting. Those of ordinary skill in the art would understand that such temperatures are application specific and are well known.

In this embodiment, the container 12 may be of any suitable composition(s) and constructed in any suitable manner to enable the container 12 to exhibit different visual characteristics. For example, the container 12 may be composed of a base material and a thermally responsive additive carried by the base material. The base material may include glass, and the additive may include a reactive material that reacts to heat sufficient to melt the fitment 14 so as to visibly change appearance of the material. For example, the container 12 may become discolored, for instance, via a change from one color to another, from a hue of a color to another hue of that color, from transparent to translucent or vice-versa, from transparent or translucent to opaque or vice-versa, and/or any other suitable discoloration qualities. The thermally responsive additive may include copper, or copper with a suitable nucleating agent, for instance, tin oxide, antimony, or molybdenum, or silver halides or any other suitable material.

In an initial state of the product 10, for example after product packaging, the container 12 may exhibit a first visual characteristic, for example, a first color. But upon product tampering, for instance, by application of heat sufficient to melt the fitment 14, the container 12 is adapted irreversibly to change a characteristic of the container 12 that is visible from outside of the container 12 to advise a user that the container 12 has been tampered with. Accordingly, the container 12 will exhibit the second visual characteristic different from the first visual characteristic. For example, the container 12 may exhibit a different color after such tampering.

Therefore, the component 11 may provide a security feature. If counterfeiters attempt to melt the fitment 14, to facilitate refilling the container 12 with counterfeit liquid product and repackaging, the refilled and repackaged package will include the state changed container 12 as evidence of product tampering. Accordingly, the product 10 is permanently or irreversibly identifiable as being a once-fillable product 10 or package. Over time, purchasers will become educated to spot such refilled counterfeit products and packages. Thus, counterfeiters will be deterred from offering counterfeit products and packages to such educated purchasers.

Figure 3:
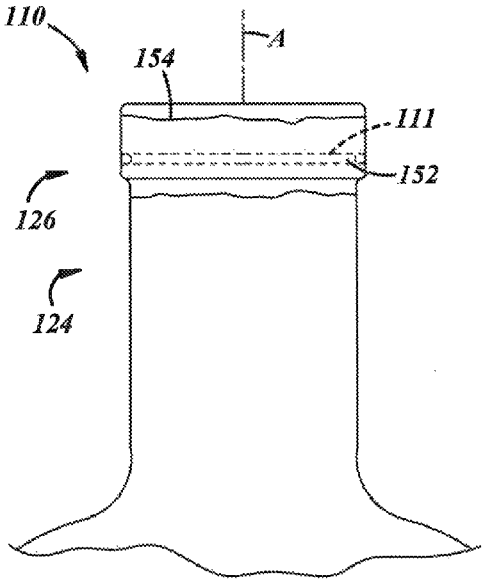
FIG. 3 is a fragmentary, elevational view of a product in accordance with another illustrative embodiment of the present disclosure and including a container and a tamper-evidencing component disposed in a pre-formed relief in the container.
Figure 4:
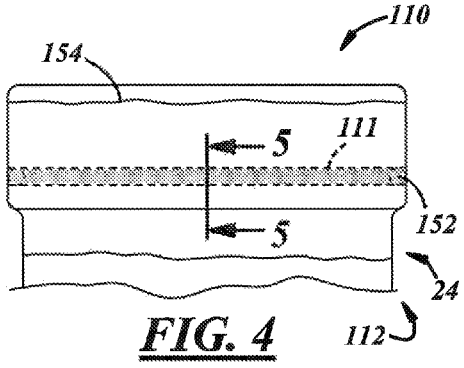
FIG. 4 is an enlarged fragmentary view of a portion of the product of FIG. 3.
Figure 5:
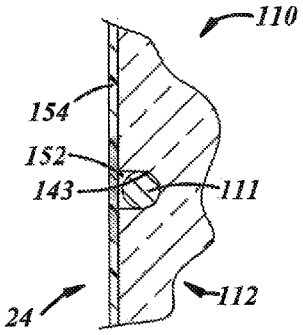
FIG. 5 is a cross-sectional view of the product of FIG. 4, taken along line 5-5 of FIG. 4.

FIGS. 3-5 illustrate another illustrative embodiment of a product 110 including a container 112 and a tamper-evidencing component 111 non-removably coupled to the container 112. This embodiment is similar in many respects to the embodiment of FIGS. 1A-2 and like numerals between the embodiments generally designate like or corresponding elements throughout the several views of the drawing figures. Accordingly, the descriptions of the embodiments are incorporated into one another. Additionally, the description of the common subject matter generally may not be repeated here.

With reference to FIG. 3, the container 112 includes a neck 124 including a neck finish 126. At least a portion of the neck 124 may be coated with a coating 154 that is thermally responsive. For example, the coating 154 may include permanent change thermochromic ink, or permanent dye in temperature activated micro capsules, or any other suitable material carried by the substrate of the container 112. The coating 154 covers the component 111. The product 110 also may include an anti-refill fitment (not shown) and, thus, may carry other components, for example, as shown in FIGS. 1A-2.

With reference to FIG. 4, the product 110 may be tampered with, wherein heat is applied to the container neck 124. The heat is sufficient to at least partially melt a plastic portion of a fitment or to thwart other anti-tampering or anti-counterfeiting devices, which may be carried in the container neck 124. The heat is also sufficient to concentrate heat within the component 111 such that the thermally responsive coating 154 changes coloration in an area corresponding to the component 111.

With reference to FIG. 5, the container 112 may include a relief 143 in an exterior surface of the container neck 124. The relief 143 may be formed during formation of the container 112. The tamper-evidencing component 111 is embedded in the container 112 by being carried in the relief 143. For example, the component 111 may be assembled into the relief 143, for example by shrink fitting the component 111 to the container 112. The component 111 may be further embedded in the container 112 by being covered with a covering material 152. The covering material 152 may include glass solder, freeze fit collar of metal or glass, thermoset plastic, or sol-gel adhesive, and may be applied by automated mechanical means, or any other suitable technique.

Figure 7:
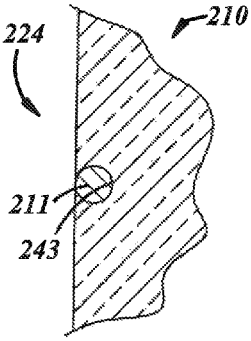
FIG. 7 is a cross-sectional view of the product of FIG. 6, taken along line 7-7 of FIG. 6.
Figure 6:
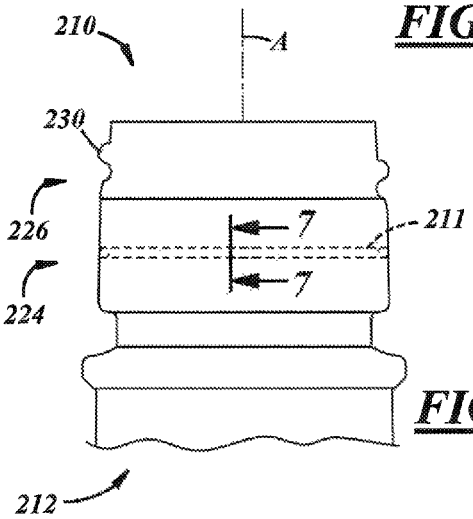
FIG. 6 is a fragmentary, elevational view of a product in accordance with another illustrative embodiment of the present disclosure and including a container and a tamper-evidencing component insert-molded to the container.

FIGS. 6-7 illustrates another illustrative embodiment of a product 210 including a container 212 and a tamper-evidencing component 211 non-removably coupled to the container 212. This embodiment is similar in many respects to the embodiment of FIGS. 1A-5 and like numerals between the embodiments generally designate like or corresponding elements throughout the several views of the drawing figures. Accordingly, the descriptions of the embodiments are incorporated into one another. Additionally, the description of the common subject matter generally may not be repeated here.

With reference to FIG. 6, in this embodiment, the container 212 includes a neck 224 including a neck finish 226 that may include one or more closure engagement features 230, for instance, thread(s), thread segment(s), or the like. The tamper-evidencing component 211 may be carried by the neck 224 just below the neck finish 226 as will be described in detail further herein below with respect to FIG. 7. The product 210 also may include an anti-refill fitment (not shown) and, thus, may carry other components, for example, as shown in FIGS. 1A-2.

With reference to FIG. 7, the container 212 may include a relief 243 in an exterior surface of the container neck 224. The relief 243 may be formed as a result of insert-molding the component 211 to the container 212 during formation of the container 212. Accordingly, the tamper-evidencing component 211 is embedded in the container 212 by being insert-molded thereto. For example, the component 211 may be insert-molded during a molding stage of container manufacturing as will be described in further detail herein below.

In general, the products described above can be produced in any suitable manner. The containers are preferably composed of glass, but may be composed of any other suitable material including plastic or metal, and may be of one-piece integrally formed construction. (The term "integrally formed construction" does not exclude one-piece integrally molded layered constructions of the type disclosed in, for example, U.S. Pat. No. 4,740,401, or one-piece containers to which other structure is added after the container-forming operation.) In a glass embodiment, the containers may be fabricated in a press-and-blow, narrow neck press-and-blow, or a blow-and-blow container manufacturing operation.

For example, a typical glass container manufacturing process includes a "hot end" and a "cold end." The hot end may include one or more glass melting furnaces to produce a glass melt, one or more forming machines to form the glass melt into containers, and one or more applicators to apply a hot-end coating to the containers. The "hot end" also may include an annealing lehr, or at least a beginning portion of the annealing lehr, for annealing the containers therein. Through the lehr, the temperature may be brought down gradually to a downstream portion, cool end, or exit of the lehr. The "cold end" may include an end portion of the annealing lehr, applicators to apply one or more cold-end coatings to the containers downstream of the annealing lehr, inspection equipment to inspect the containers, and packaging machines to package the containers.

In conjunction with the above description, the containers may be produced by the following container manufacturing process, which may or may not include all of the disclosed steps or be sequentially processed or processed in the particular sequence discussed, and the presently disclosed manufacturing process encompass any sequencing, overlap, or parallel processing of such steps.

First, a batch of glass-forming materials may be melted. For example, a melting furnace may include a tank with melters to melt soda-lime-silica to produce molten glass. Thereafter, the molten glass may flow from the tank, through a throat, and to a refiner at the downstream end of the furnace where the molten glass may be conditioned. From the furnace, the molten glass may be directed toward a downstream forehearth that may include a cooling zone, a conditioning zone, and a downstream end in communication with a gob feeder. The feeder may measure out gobs of glass and deliver them to a container forming operation.

Next, the glass gobs may be formed into containers, for example, by forming machines, which may include press-and-blow or blow-and-blow individual section machines, or any other suitable forming equipment. Blank molds may receive the glass gobs from the feeder and form parisons or blanks, which may be at a temperature on the order of 900-1100 degrees Celsius. Blow molds may receive the blanks from the blank molds and form the blanks into containers, which may be at a temperature on the order of 700-900 degrees Celsius. Material handling equipment may remove the containers from the forming machines and place the containers on conveyors or the like.

Also, the formed containers may be annealed, for example, by an annealing lehr. At an entry, hot end, or upstream portion of the annealing lehr, the temperature therein may be, for instance, on the order of 500-700 degrees Celsius. Through the lehr, the temperature may be brought down gradually to a downstream portion, cool end, or exit of the lehr, for example, to a temperature therein on the order of 100 degrees Celsius.

At any suitable point(s) in the manufacturing process, the containers are embedded with a tamper-indicating element.

In one example, the tamper-evidencing components may be applied to the blanks in the blank molds or to the containers in the blow molds, for instance, by insert molding the components onto the container necks of the blanks or the containers as they are formed. For example, a robotic arm or pick-and-place unit may be used to pick up a component and place it in a recess or detent in a blank mold, for example, in a location of the blank mold just below or adjacent to a neck ring used to form the neck finish. Accordingly, in one embodiment, a forming step may include sub-steps of forming a blank and then forming the container from the blank, wherein the component is insert molded to the blank during the blank forming step. In another embodiment, the forming step may includes sub-steps of forming a blank and then forming the container from the blank, wherein the component is insert molded to the container during the container forming step.

In another example, the components may be applied to the containers downstream of the blow molds. For instance, portions of the containers may be formed in the blank or blow molds to include recesses to accept the components in a downstream assembly operation. More specifically, the container forming step may include forming a recess in a radially outward surface of a container neck. Accordingly, the retaining step may include placing the component in the recess to non-removably retain the component to the container.

According to a first embodiment, the retaining step may include shrink fitting the component around the container neck. For example, the component may be heated and/or the container cooled and assembled over a comparatively cold container neck and allowed to cool and shrink tightly around the container neck. Also, the retaining step may include applying solder glass over the component and adjacent portions of the container.

According to a second embodiment, the retaining step may include placing the component within the recess between the molding step and the annealing step while the container is still relatively soft, and swaging a portion of the container over the component to trap the component to the container to non-removably retain the component to the container. In any case, the components are non-removably retained to corresponding wall(s) of the containers so that the components cannot be removed without destroying or damaging the containers, such that the components serve as tamper-resistant authentication markers.

There thus has been disclosed products and methods that fully satisfy all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A product that includes:

a container including a neck; and a tamper-evidencing component separate from the container and carried by the neck of the container in direct contact with a corresponding portion of the container neck and composed of material that has higher thermal conductivity than that of a material of the container so as to concentrate heat in the corresponding portion of the container neck, wherein the container neck is thermally responsive to application of heat pursuant to tampering with the product by an irreversible change in visual appearance of the corresponding portion of the container neck corresponding to the component, wherein the container is composed of a base material and a thermally responsive material carried by the base material so as to visibly change appearance of the container in response to transfer of heat from the component upon application of the heat pursuant to tampering.

2. The product set forth in claim 1, wherein the product is an anti-refill product, and also includes an anti-refill dispensing fitment non-removably coupled in the container neck.

3. The product set forth in claim 2, wherein the container is a bottle having a body and the neck with a neck interior surface, and the fitment includes an outer wall carrying the component in direct contact with an interior surface of the container neck.

4. The product set forth in claim 3, wherein the fitment includes a inlet wall, an outlet wall axially spaced from the inlet wall, and a check valve carried radially inwardly of the outer wall of the fitment, and wherein at least a portion of the fitment is composed of plastic.

5. The product set forth in claim 1, wherein the component is composed of metal and the container is composed of glass or ceramic.

6. The product set forth in claim 1, wherein the component is embedded in an external surface of the container neck.

7. The product set forth in claim 6, wherein the component is carried in a preformed groove of the external surface of the container neck.

8. The product set forth in claim 6, wherein the component is insert-molded in the external surface of the container neck.

9. The product set forth in claim 1, wherein the tamper-evidencing component is a metal ring.

10. The product set forth in claim 1, that also includes an anti-refill fitment carried in the neck to deter refill of the container and at least partially composed of plastic.

11. The product set forth in claim 10, wherein the fitment includes an outer wall carrying the metal component in direct contact with an interior surface of the container neck.

12. The product set forth in claim 1, wherein the container is composed of a base material and a thermally responsive material carried by the base material that changes in appearance upon said heating.

13. The product set forth in claim 1, wherein the tamper-evidencing component is a snap ring carried in an interior of the container neck.

14. The product set forth in claim 2, wherein the container is a glass container, and the tamper-evidencing component is a metal component carried in at least one of the neck of the container or the fitment and in contact with a corresponding portion of the container neck, such that heating of the product pursuant to product tampering results in at least one of discoloration of the container neck or fracture of the container neck.

15. A product that includes:

a container including a neck; and a tamper-evidencing circumferentially continuously extending ring separate from the container and carried by the neck of the container in direct contact with a corresponding portion of the container neck and composed of material that has higher thermal conductivity than that of a material of the container so as to concentrate heat in the corresponding portion of the container neck, wherein the container neck is thermally responsive to application of heat pursuant to tampering with the product by fracture of the container neck at the corresponding portion of the container neck.

16. The product set forth in claim 15, that also includes an anti-refill fitment carried in the neck to deter refill of the container and at least partially composed of plastic.

17. The product set forth in claim 16, wherein the container is a glass container, and the ring is a metal component carried in at least one of the neck of the container or the fitment and in contact with a corresponding portion of the container neck, such that heating of the product pursuant to product tampering results in fracture of the container neck.

18. The product set forth in claim 17, wherein the fitment includes an outer wall carrying the metal component in direct contact with an interior surface of the container neck.

19. The product set forth in claim 15, wherein the container is composed of a base material and a thermally responsive material carried by the base material that changes in appearance upon said heating.

20. The product set forth in claim 15, wherein the ring is embedded in an external surface of the container neck.

21. The product set forth in claim 20, wherein the ring is carried in a preformed groove of the external surface of the container neck.

22. The product set forth in claim 20, wherein the ring is insert-molded in the external surface of the container neck.

23. The product set forth in claim 15, wherein the ring is a snap ring carried in an interior of the container neck.

* * * * *